United States Patent [19]

Kubelka

[11] 4,229,862

[45] Oct. 28, 1980

[54] STRAP TENSIONING BUCKLE

[75] Inventor: Axel R. Kubelka, Kirchstetterngasse 47, A 1160 Vienna, Austria

[73] Assignees: Erwin Weigl; Axel Kubelka, both of Vienna, Austria

[21] Appl. No.: 879,717

[22] Filed: Feb. 21, 1978

[30] Foreign Application Priority Data

Feb. 22, 1977 [AT] Austria ..... 1185/77

[51] Int. Cl.[2] ..... A43C 11/00

[52] U.S. Cl. ..... 24/68 SK; 24/170

[58] Field of Search ..... 24/68 R, 68 SB, 68 AS, 24/68 CD, 68 SK, 68 A, 68 E, 68 T, 71 ST, 71 SB, 71 SK, 69 SK, 70 SK, 170

[56] References Cited

U.S. PATENT DOCUMENTS

| | | | |
|---|---|---|---|
| 638,725 | 12/1899 | Koontz et al. | 24/68 SK |
| 2,442,266 | 5/1948 | Davis | 24/170 |
| 3,162,914 | 12/1964 | Ireland | 24/170 |

*Primary Examiner*—Kenneth Dorner

*Attorney, Agent, or Firm*—Cushman, Darby & Cushman

[57] ABSTRACT

A strap tensioning buckle for a strap-like pull element on ski boots or the like comprises a tensioning lever pivotable to a tightening position and hinged onto an eye fixed to a base plate or other structure on the boot, two arms adjacent to the hinge axis and distant from each other by a clearance equal at least to the width of the pull element and allowing between them a passageway for the element, and a clamping device for holding the pull element.

7 Claims, 5 Drawing Figures

STRAP TENSIONING BUCKLE

This invention relates to a strap tensioning buckle for a strap-like pull element on ski boots or the like, said buckle comprising a tensioning lever turnable into a tightening position and hinged onto an eye solid with a base plate fixed on the boot or on an element connected to said boot, and further comprising two arms adjacent to the hinge axis and distant from each other by a clearance equal at least to the width of said pull element and allowing between them a passageway for said element, and furthermore comprising a clamping device for holding the pull element.

In tensioning buckles for straps used on shoes, it is common practice that the strap is connected to a cross bar which may be put into a lever. Several positions are eligible. Usually, the surface of the strap facing the shoe is provided with a tooth-like profile into which said cross bar is engaged. In most cases, the number of possible positions is small, which means that the locking force is not adjustable exactly enough. However, the chief shortcoming of the known tensioning buckles consists in the circumstance that said cross bar leaves its position in the toothed profile each time when the buckle is opened, which necessitates to search again the proper position when the buckle is to be locked. Another tensioning buckle has become known comprising a highly flexible strap-like pull element which is twisted around a holding means where it is maintained by means of a clamping device. But an intricate operation becomes necessary when the tensioning element has been completely loosened from the tensioning buckle. This kind of tensioning buckle is not suitable for strap-like pull elements which are formed corresponding to the body of a ski boot since such straps are not flexible enough.

Object of the present invention is a strap tensioning buckle which is usable also with a relatively stiff pull element and which allows completely opening the same maintaining the pull element in its selected position. To solve this problem the invention consists essentially in that the tensioning lever in the portion opposite to the hinge axis is provided with a clamping lever and a cover plate covering said pull element, that the clamping lever is pivotally mounted in the tensioning lever, its pivotal axis being substantially parallel to the hinge axis of the tensioning lever, and its free end being directed opposite to the direction of the tensile load acting on the pull element, that the length of the clamping lever is greater than the perpendicular distance between its pivotal axis and the lower surface of the cover plate, diminished by the thickness of the pull element, and that at least a portion of the surface of the pull element is provided with a toothed profile matching with a counterprofile on the clamping lever and/or the cover plate. In this way it is possible to insert into the buckle a strap formed like the body of a ski boot, even without mediation of a cross bar connected to the strap. The best fitting position for inserting the strap may be selected out of a continuous series of possibilities. Once the position has been selected, the strap is fixed or clamped in the tensioning lever, the clamping point being located in a portion of the lever opposite to the hinge axis. In this point, i.e. between the clamping lever and the cover plate, the pull element remains clamped even when the buckle is open, so that it is not necessary to find out anew the appropriate length of the strap when closing the buckle. On the other hand, it is possible to take out completely the strap only by acting on the clamping lever. As a result of the fact that in accordance with the invention the clamping lever is pivotally mounted in the tensioning lever, its pivotal axis being substantially parallel to the hinge axis of the tensioning lever, and its free end being directed opposite to the direction of the tensile load acting on the pull element and that the length of the clamping lever is greater than the perpendicul distance between its pivotal axis and the lower surface of the cover plate, diminished by the thickness of the pull element, it is achieved that a tensile load acting on the strap urges the clamping lever into its locking position. Therefore, a variety of materials is usable for the pull element which can be made e.g. from the material of the uppers or the collar of the ski boot or shaped accordingly to the form of the ski boot. Furthermore, it is provided that at least a portion of the surface of the pull element has a toothed profile matching with a counter-profile on the clamping lever and/or the cover plate, and this measure serves to secure the position of the strap within the clamping device. The length of the strap is much more exactly adjustable than with the common buckles for ski boots.

A preferred embodiment of the invention is characterized by the feature that said toothed profile is provided on that side of the pull element which is directed toward the surface of the boot, and that said profile matches with a counter-profile of the clamping lever which is spring urged against said pull element and the cover plate, thus minimizing the possibility of damaging the toothed profile of the strap. The clamping lever may be pivotally mounted in the tensioning lever and may be provided with at least one laterally projecting grip element by means of which the clamping lever is detachable from the pull element, which in this way can be completely drawn out of the buckle or rearranged in order to regulate the tension.

In a simple manner can be provided that the side of the clamping lever directed toward the lower face of the cover plate has a curved configuration, that the clamping lever is pivotally supported in the cover plate portion of the tensioning lever, its pivotal axis being eccentrical with respect to said curved configuration, and that a resilient force urges the clamping lever in a direction narrowing the gap between its upper surface and the lower surface of the plate.

Another possibility consists in that the pivot axis of the clamping lever is located in a central region of the cover plate portion of the tensioning lever, that one end of the clamping lever is provided with a counter-profile engageable to the toothed profile of the pull element, that the clamping lever is elongated beyond its pivot axis, and that this elongation can be optionally pressed against the cover plate portion of the tensioning lever at the end thereof opposite to the clamping point of the pull element, the pivot axis of the clamping lever preferably being conincident with the pivot axis of two arms by means of which the tensioning unit is hingedly fixed.

In a preferred embodiment it can be provided that the arms of the tensioning lever are disengageably hinged to the base element. For loosening completely the strap it will be sufficient to snap out the strap along with the tensioning lever. When the lever shall be snapped back again, it is no need adjusting anew the length of the strap. Preferably the arms of the tensioning lever are pivotally connected to the cover plate portion of the same, the cover plate portion being turned away from the hinge axis, and serving to cover the pull element, which permits a strap of relatively high stiffness to be used since the strap is not excessively bend stressed though being held by the clamping device at the portion thereof opposite the hinge axis.

In the accompanying drawings embodiments of the invention are shown by way of examples.

Figure 1:
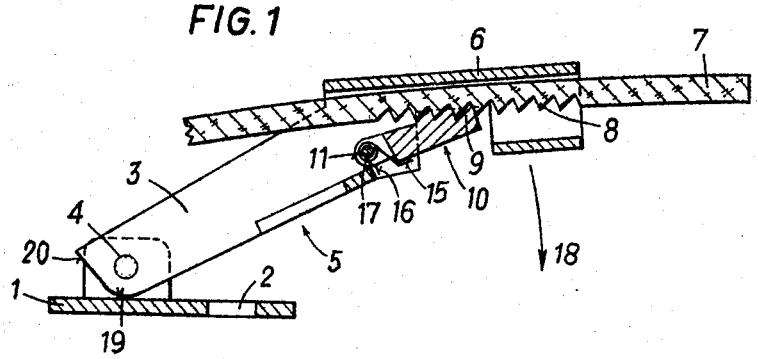
FIG. 1 shows a cross-section of the strap tensionin buckle according to the invention, taken along the line II—II in FIG. 2.
Figure 2:
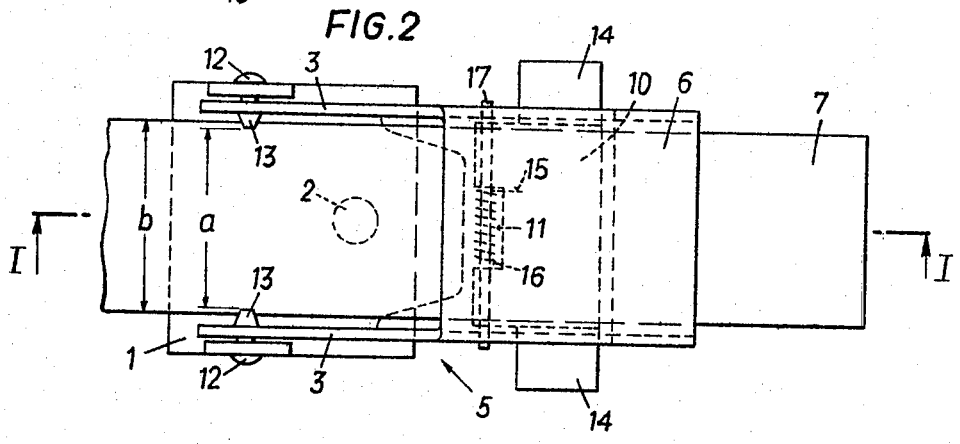
FIG. 2 is a top plan view of the tensioning buckle.

As can be seen from FIG. 1, a base plate 1 has a bore 2, said base plate being connectable to the shell by means of a rivet (not shown) which may be inserted through said bore 2. Arms 3 are hinged onto the base plate 1, being turnable about an axis 4. The strap 7 is secured by a cover plate 6 provided on the tensioning lever 5 at the upper end thereof opposite to the axis 4. The strap 7 is toothed at 8 on its lower side while a clamping lever 10 is provided on its upper side with a toothing 9 matching and engaging said toothing 8 of said strap. A coil spring 11 urges the clamping lever 10 into a position where the strap is pressed against the cover plate 6. As best seen in FIG. 2 the axis 4 is defined by two short rivets 12 whose inner ends are formed as blunted conical caps 13, the free distance a between these caps being slightly shorter than the width b of the strap 7. Thus the strap is maintained below said hinging axis 4 while the tensioning lever 5 is in a closed position, and the strap tensioning buckle cannot be opened accidentally. Projecting laterally over the tensioning lever 5 there are provided on the clamping lever 10 two grip elements 14. By pressing downwards said grip elements 14 the clamping lever 10 is moved out of its engaging position shown in FIG. 1 against the force of the coil spring 11 whose one end 15 is biased against the clamping lever 10 while the other end 16 thereof is rigidly fixed at a rigid portion of the tensioning lever 5, the swivelling axis 17 of said clamping lever 10 coinciding with the center line of the coil spring 11.

With a strap tensioning buckle of this kind it is sufficient to insert the strap 7 into the portion of the tensioning lever 5 supporting the cover plate 6. Tensioning occurs in a simple manner by rotating the tensioning lever 5 in the direction of the arrow 18 about the rivet axis 4. By this movement the strap 7 is pressed into a position as shown in FIG. 2, i.e. below the conical caps 13. If tensile forces are applied on the strap 7, they generate only stress components tending to close the buckle, i.e. to move the plate 6 in the direction of the arrow 18. It should be noted that the lower edge 19 of the arms 3 in the region of their axis 4 has a rounded contour having a tangentially shaped continuation 20. Thus the opening motion of the buckle by turning the lever 5 contrary to the arrow 18 is limited by the contact between the surface 2 and the base plate 1.

Figure 3:
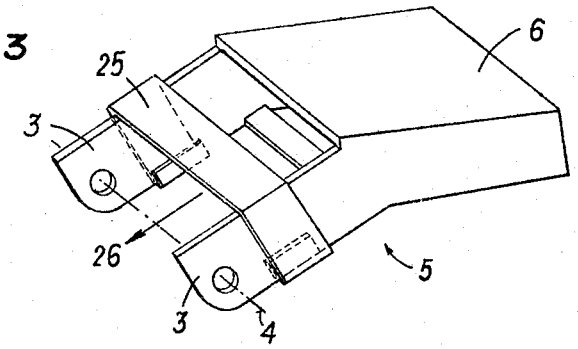
FIG. 3 is a perspective view of a second embodiment omitting the clamping device.

The embodiment illustrated in FIG. 3 shows a sliding element 25 surrounding the arms 3 and covering the interspace between the same in order to prevent the straps 7 from being inadvertently forced upwards. After the buckle has been closed the element 25 is moved downwards in the direction of the arrow 26 to cover the strap. The element 2 as well as the plate 21 may be provided on their lower side with knobs (not shown) urging the strap 7 from above and pressing it down against the base plate 1.

Figure 4:
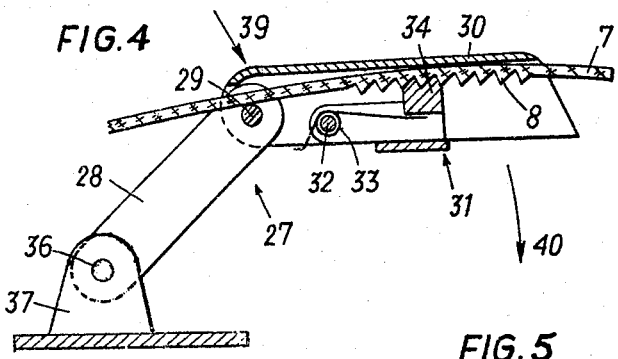
FIGS. 4 and 5 are a cross-sectional and plan view, respectively, of a third embodiment.
Figure 5:
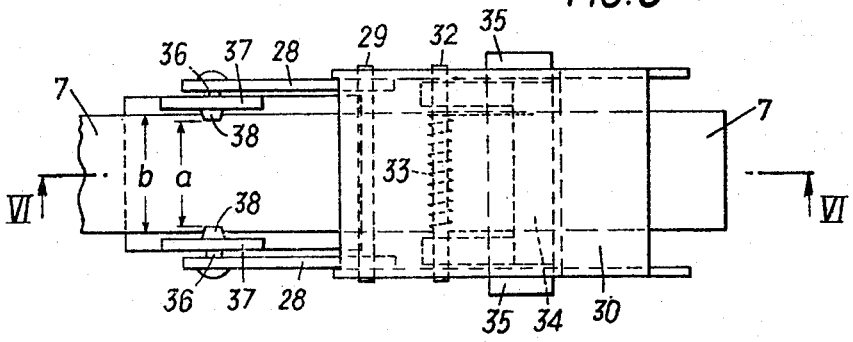

Another embodiment of the invention is to be seen in FIGS. 4 and 5 where a pair of arms 28 of the tensioning lever 27 are pivotally connected by means of an axis 29 to the plate 30 covering the strap 7. The clamping lever 31 is pivotally mounted by an axle 32 to the piece comprising said cover plate 30. An upper portion of the clamping lever 31 is provided with a toothed profile 34, and a spring 33 tends to press the said profile upwards against the cover plate 30. Two grip elements 35 projecting from the clamping lever 31 permit this lever 31 to be turned down freeing its toothed profile 34 from a toothed counterprofile 8 provided on the lower side of the strap 7. The arms 28 are hinged at 36 to an eye 37 solid with the base plate 1. The hinge axis 36 is defined, similarly as in FIG. 2, by a pair of rivets ending on the inner side with a conical cap 38. The distance a between the conical caps 38 is slightly narrower than the width b of the strap 7. Consequently, once the strap is positioned between the rivet caps 38 and the base plate 1, it cannot be inadvertently forced upwards to its open position as shown in FIG. 6. To tighten the buckle one need nothing than exert a pressure against the cover plate 30 or the arms 28 in the region of their common axis 29 about in the direction of the arrow 39. This will effect a movement of these parts following in general the arrow 40, locking so the tensioning buckle.

What we claim is:

1. A strap tensioning buckle for a straplike pull element on ski boots or the like, said buckle comprising a tensioning lever turnable into a tightening position and hinged for movement about a hinge axis onto an eye fixed with a base plate fixed on the boot or on an element connected to said boot, and further, comprising two arms adjacent to the hinge axis and distant from each other by a clearance equal at least to the width of said pull element and allowing between them a passageway for said pull element, and furthermore comprising a clamping device for holding the pull element, said tensioning buckle being characterized in that the tensioning lever in the portion opposite to the hinge axis is provided with a clamping lever and a cover plate covering said pull element, that the clamping lever is pivotally mounted in the tensioning lever, its pivotal axis being substantially parallel to the hinge axis of the tensioning lever, and its free end being directed opposite to the direction of the tensile load acting on the pull element, that the length of the clamping lever is greater than the perpendicular distance between its pivotal axis and the lower surface of the cover plate, diminished by the thickness of the pull element, and that at least a portion of the surface of the pull element is provided with a toothed profile matching with a counter-profile on the clamping lever.

2. The strap tensioning buckle of claim 1, characterized in that said toothed profile is provided on that side of the pull element which is directed toward the surface of the boot, and that said profile matches with a counter-profile of the clamping lever which is spring urged against said pull element and the cover plate (6).

3. The strap tensioning buckle according to claim 1 or 2, further characterized in that the clamping lever pivotally mounted in the tensioning lever is provided with at least one laterally projecting grip element by means of which the clamping lever is detachable from the pull element.

4. A strap tensioning buckle according to claim 1 or 2, further characterized in that a resilient force urges the clamping lever in a direction narrowing the gap between its upper surface and the lower surface of the cover plate.

5. A strap tensioning buckle according to claim 1 or 2, further characterized in that the arms of the tensioning lever are pivotally connected to the cover plate of the tensioning lever, the cover plate extending away from the hinge axis and serving to cover the pull element.

6. A strap tensioning buckle according to claim 1 or 2 further characterized in that the arms of the tensioning lever are disengageably hinged to the base element.

7. A strap tensioning buckle according to claim 1 or 2, further characterized in that the turning movement of the tensioning lever about its hinge axis in an opening direction is limited by contact surfaces provided on the arms.

* * * * *